US007067053B2

(12) United States Patent
Cotte et al.

(10) Patent No.: US 7,067,053 B2
(45) Date of Patent: Jun. 27, 2006

(54) ADDITIVES FOR IMPROVING THERMAL CONVERSION OF HEAVY CRUDE OIL

(75) Inventors: Edgar A Cotte, Caracas (VE); Ivan C. Machin, Los Teques (VE)

(73) Assignee: Intevep, S.A., Caracas (VE)

( * ) Notice: Subject to any disclaimer, the term of this patent is extended or adjusted under 35 U.S.C. 154(b) by 655 days.

(21) Appl. No.: 10/223,188

(22) Filed: Aug. 16, 2002

(65) Prior Publication Data

US 2004/0031726 A1 Feb. 19, 2004

(51) Int. Cl.
*C10G 47/32* (2006.01)

(52) U.S. Cl. ..... 208/431; 208/56; 208/67; 208/106; 208/107

(58) Field of Classification Search ..... 208/431, 208/56, 67, 106, 107
See application file for complete search history.

(56) References Cited

U.S. PATENT DOCUMENTS 3,692,662 A * 9/1972 Wilson et al. ..... 208/429
3,839,187 A 10/1974 Vanvenrooy
4,090,947 A 5/1978 Satchell, Jr.
4,298,455 A 11/1981 Huang
4,378,288 A 3/1983 Shih et al.
4,514,282 A 4/1985 Poynor et al.
4,587,007 A * 5/1986 Rudnick ..... 208/107
4,592,826 A * 6/1986 Ganguli ..... 208/407
4,642,175 A 2/1987 Rudnick
4,698,198 A 10/1987 Gruen
4,784,744 A 11/1988 Rudnick
4,814,065 A * 3/1989 Rankel ..... 208/85
5,006,223 A 4/1991 Wiehe et al.

* cited by examiner

*Primary Examiner*—Tam M. Nguyen
(74) *Attorney, Agent, or Firm*—Bachman & LaPointe, P.C.

(57) ABSTRACT

A process for upgrading a heavy crude oil includes the steps of providing a heavy crude oil; and exposing the heavy crude oil to residue conversion conditions in the presence of a free radical generator and a hydrogen donor, whereby the free radical generator enhances reactions to form distillates, and the hydrogen donor inhibits reactions to form coke.

8 Claims, 2 Drawing Sheets

ADDITIVES FOR IMPROVING THERMAL CONVERSION OF HEAVY CRUDE OIL

BACKGROUND OF THE INVENTION

The invention relates to a process for conversion of heavy crude oil and, more particularly to a pyrolytic process wherein conversion to distillates is increased without excessive production of coke.

Pyrolytic processes, that is, conversion processes for upgrading crude oil which involve relatively high temperatures and pressures, allow conversion of residue to obtain lighter products such as distillates which are of increased value.

The process used to obtain such increased-value products can add substantially to the cost of obtaining these products. Further, conventional processes do not provide conversion rates as high as would be desired, and furthermore can produce additional products such as coke which are not desirable.

It is clear that the need remains for improved processes for converting heavy crude oil, and residues contained in same, so as to obtain valuable distillate products without excessive production of undesirable products, in a manner which does not significantly increase the cost for obtaining the desired end product.

It is therefore the primary object of the present invention to provide such a process.

It is a further object of the present invention to provide a process which enhances distillate forming reactions while inhibiting or reducing reactions which tend to form undesirable byproducts.

Other objects and advantages of the present invention will appear hereinbelow.

SUMMARY OF THE INVENTION

In accordance with the present invention, the foregoing objects and advantages have been readily attained.

According to the invention, a process is provided for upgrading a heavy crude oil, which process comprises the steps of providing a heavy crude oil; and exposing said heavy crude oil to residue conversion conditions in the presence of a free radical generator and a hydrogen donor, whereby said free radical generator enhances reactions to form distillates, and said hydrogen donor inhibits reactions to form coke.

BRIEF DESCRIPTION OF THE DRAWINGS

A detailed description of preferred embodiments of the present invention follows, with reference to the attached drawings, wherein.

DETAILED DESCRIPTION

Figure 1:
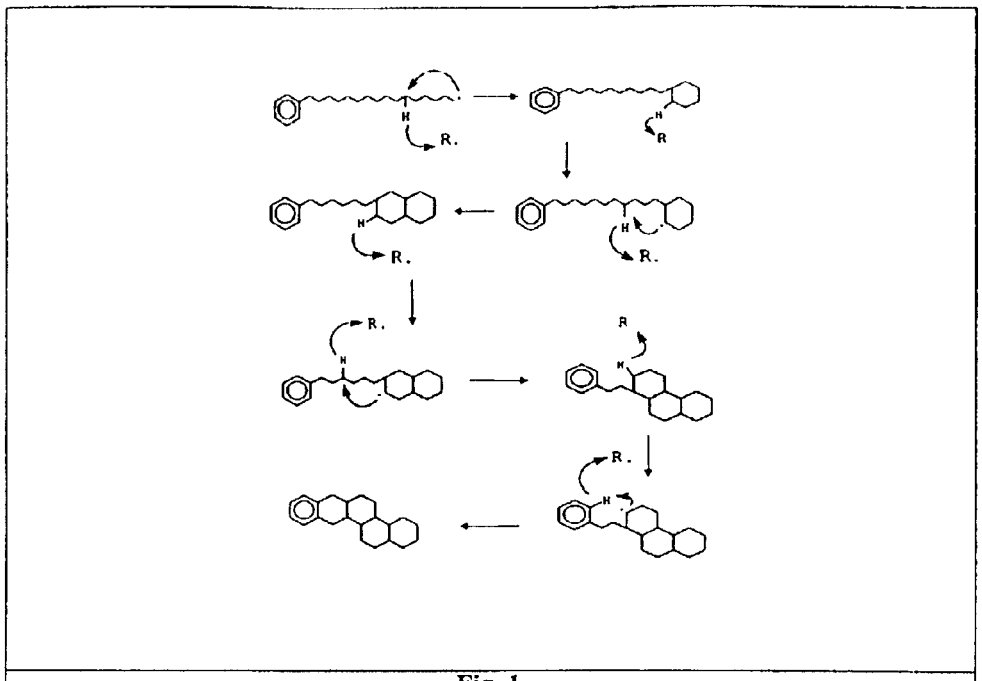
FIG. 1 schematically illustrates a cyclization mechanism corresponding to undesirable coke formation in certain processes.

The invention relates to a process for upgrading a heavy crude oil and, more particularly, to a process for upgrading or converting residue within a heavy crude oil to form desirable distillate products while minimizing formation of coke. Heavy crude oils such as, but not limited to, Hamaca crude from Venezuela contain residues which can be converted into distillates or other lighter products, thereby increasing the value of same. Pyrolysis processes involve exposing the heavy crude oil or resides contained therein to increased pressures and temperatures so as to crack the residue. This can produce conversion to distillates, but at conversion rates which are relatively low, and these processes also tend to generate coke.

In accordance with the present invention, it has been found that conducting such processes in the presence of a free radical generator tends to enhance the formation of both distillates and coke, and further, that carrying out such processes in the presence of both a free radical generator and a hydrogen donor serves to increase distillate production while minimizing coke production, as desired in accordance with the present invention.

The pyrolytic process of the present invention is typically a process carried out under conventional residue conversion conditions, typically including a temperature of at least about 380° C., and preferably between about 380° C. and about 500° C., more preferably between about 430° C. and about 500° C. and a pressure of at least about 800 psi, preferably between about 800 psi and about 900 psi, which serves to crack at least a portion of the residue contained in the feed so as to produce the desired distillates.

In accordance with the present invention, it has been found that through the use of both a free radical generator and a hydrogen donor, activity toward the desired cracking reactions which form distillates can be increased, while nevertheless suppressing the cycling reactions which tend to form coke.

In accordance with the present invention, preferred free radical generators include various types of additives which can encourage the presence of free radicals in the reaction mixture. Preferred examples of free radical generators include octyl nitrate (OctN), TAME, MTBE and the like, most preferably octyl nitrate.

Suitable hydrogen donors in connection with the present invention include tetraline (THN) and other like materials which act as a hydrogen donor under process conditions, preferably tetraline.

In accordance with the present invention, it has been found that excellent results can be obtained using free radical generator in an amount of between about 1 and about 18% wt/wt with respect to the crude, and by using hydrogen donor in an amount between about 1 and about 18% wt/wt, also with respect to the crude. Furthermore, it has been found that the free radical generator and hydrogen donor may also advantageously be utilized at a ratio of hydrogen donor to free radical generator, by weight, of between about 1 and about 10.

In accordance with the present invention, it has been found that a free radical generator such as octyl nitrate increases conversion rates to both distillate and coke. The increased conversion obtained with such an additive can be explained with the model discussed below. A residue molecule M-N is thermally cracked to generate free radicals:

$$\text{M-N} \rightarrow \text{M.} + \text{N.} \qquad 4\text{-}1)$$

These radicals "r." (where r. can be M. or N.), attack the M-N molecules of the crude:

$$\text{M-N} + r. \rightarrow \text{M.} + \text{N-}r \qquad 4\text{-}2)$$

The reaction velocity of reactions 4-1) and 4-2) can be expressed by the following equation:

$$V=d[M\text{-}N]/dt=k1[M\text{-}N]+k2[M\text{-}N][r.] \quad 4\text{-}3)$$

Where k1 and k2 are the kinetic constants of reactions 4-1 and 4-2, respectively, and [M-N] and [r.] are the molar concentrations of the residue and the free radicals.

Therefore, the addition of a free radical generator in the reaction system will increase the reaction velocity and we can expect an increase of the residue conversion. This explains the increase in residue conversion with the addition of the additive OctN.

On the other hand, it was also found that the incorporation of OctN also increases coke generation when reacted with the Hamaca residue. For example, increased coke formation was experienced with the OctN additive as compared to processes without the additive. The above model explains this as well. The M and N radicals not only can attack the M-N molecules to give distillates, they also can generate cycles through the mechanism shown in FIG. 1.

Therefore, there are two reactions competing in the pyrolysis process, the cracking reaction to produce distillates and the cycling reaction to produce coke. The cycles associated with hydronaphthenes have a strong tendency to generate aromatic rings by dehydrogenation, which results in coke. Another cokification mechanism is based on the composition of the crude oil in aromatic ring nuclei systems surrounded by aliphatic chains. The thermal cracking breaks the bonding of these aliphatic chains with the aromatic nuclei and the latter polymerize to give coke as the final product. However, THN acts as a hydrogen donor. Therefore this additive acts as a coke inhibitor because it interacts with the radicals that, as shown in the model, can result in coke.

The process of the present invention is preferably carried out utilizing free radical generators such as octyl nitrate in an amount between about 1 and about 10% wt/wt with respect to the heavy crude oil being treated, and further in the presence of hydrogen donors such as tetraline in an amount between about 1 and about 35% wt/wt with respect to the heavy crude oil being treated. Thus, free radical generator and hydrogen donor are preferably utilized in combination in a ratio, by weight, of free radical generator to hydrogen donor of between about 1:35 and about 10:1.

The following examples further illustrate excellent results obtained in accordance with the present invention.

EXAMPLE 1

In this example, a Venezuelan extra heavy crude oil (Hamaca) containing a >500° C. residue was used. 70 g of this residue was placed in a batch reactor having a capacity of 300 cc, and was heated to 60° C. A mixture of 21 g of tetraline and 7 g of octyl nitrate were added. The reaction was then run at 420° C. and 900 psi for 120 minutes. A sand oven from Techne, Model SBL-2D, coupled with a temperature controller from Omega, Model 199, was used for the heating. Gas analysis was conducted using a gas chromatograph Carle 400 equipped with a TCD detector and 7 columns of the type chromosorb, molecular sieve and porapack. Mass balances were obtained between 92 and 98%.

Conversion was conducted of this Hamaca residue in the presence of octyl nitrate free radical generator in an amount of 10% wt/wt, at 420° C., 300 psi, for 40 minutes. The same reaction was carried out without the free radical generator. With the free radical generator, residue conversion of 56% was obtained, as compared to only 40% without the additive. However, when using the free radical generator, a coke formation of 22% was also observed, as compared to a coke formation of only 8% without the additive. Thus, the free radical generator alone serves to increase both the cracking and cycling reactions, and therefore increases production of distillates and coke.

Figure 2:
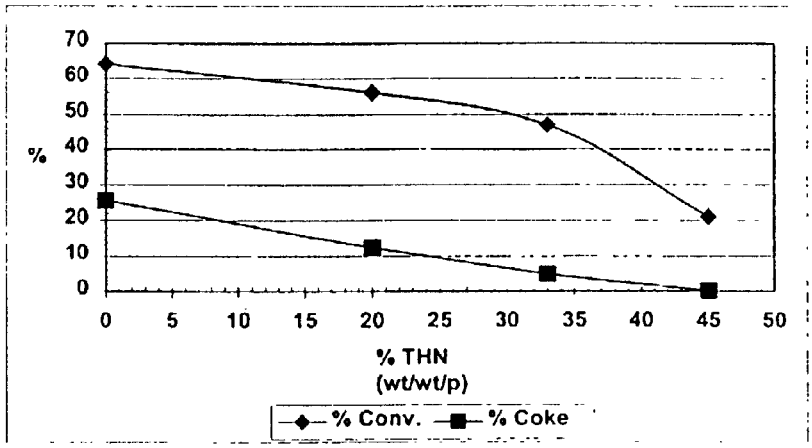
FIG. 2 illustrates conversion rate and coke formation rate for a process conducted using Hamaca residue, in the presence of 10% wt/wt of a free radical generator, for increasing amounts of hydrogen donor.

For the same process conditions, the hydrogen donor was also added in various amounts in combination with 10% wt/wt of the octyl nitrate free radical generator. Results in terms of conversion and coke formation are as shown in FIG. 2, and show that the hydrogen donor inhibits both coke formation and, to some extent, distillate production. As shown in FIG. 2, an excellent window exists wherein the hydrogen donor suppresses coke formation while nevertheless allowing increased and desirable amounts of conversion to distillates, as desired in accordance with the present invention.

Figure 3:
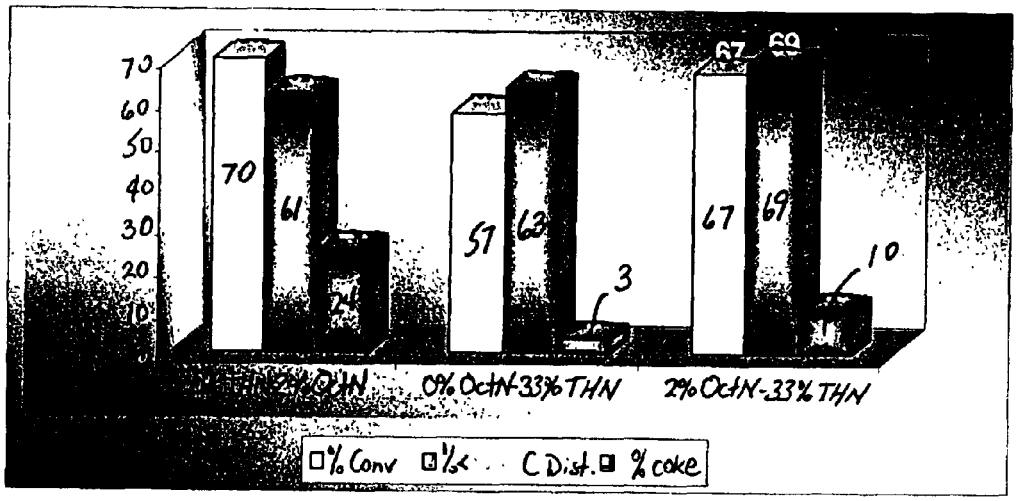
FIG. 3 illustrates conversion and coke formation for processes carried out using no additives, only a free radical generator, only a hydrogen donor, and both a free radical generator and a hydrogen donor.

FIG. 3 shows comparative results for processes conducted with only 2% free radical generator (OctN), only 33% wt hydrogen donor (THN), and a combination in accordance with the present invention of 2% free radical generator and 33% hydrogen donor. FIG. 3 presents results obtained in each of these processes, in terms of percent conversion, percent of <500° C. distillates obtained, and percent of coke. As shown, the combination of free radical generator and hydrogen donor in accordance with the present invention provided for the greatest production of <500° C. distillates, as desired, and also provided much less coke production then was produced without the hydrogen donor. Thus, the combination of additives in accordance with the present invention advantageously serves to increase production of desired distillates, while controlling production of undesirable coke.

In accordance with the present invention, it should readily be appreciated that a process has been provided wherein free radical generators and hydrogen donors are used to guide a process for upgrading a heavy crude oil, specifically for converting residue to distillates, so as to increase distillate production while minimizing coke formation as desired.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for upgrading a heavy crude oil, comprising the steps of:

providing a heavy crude oil; and exposing said heavy crude oil to residue conversion conditions in the presence of a free radical generator comprising octyl nitrate and a hydrogen donor, whereby said free radical generator enhances reactions to form distillates, and said hydrogen donor inhibits reactions to form coke.

2. The process of claim 1, wherein said heavy crude oil comprises a >500° C. residue.

3. The process of claim 1, wherein said residue conversion conditions include a temperature of at least about 380° C. and a pressure of at least about 800 psi.

4. The process of claim 3, wherein said temperature is between about 380° C. and about 500° C., and said pressure is between about 800 psi and about 900 psi.

5. The process of claim 4, wherein said temperature is between about 430° C. and about 500° C.

6. The process of claim 1, wherein said hydrogen donor is tetraline.

7. The process of claim 1, wherein said free radical generator has activity toward cracking reactions which produce distillates and cycling reactions which produce coke, and wherein said hydrogen donor inhibits said cycling reactions.

8. The process of claim 1, wherein said free radical generator is present in an amount between about 1 and about 10% wt/wt with respect to said heavy crude oil, and wherein said hydrogen donor is present in an amount between about 1 and about 35% wt/wt with respect to said heavy crude oil.

* * * * *